US009619972B2

(12) United States Patent
Ginac et al.

(10) Patent No.: US 9,619,972 B2
(45) Date of Patent: Apr. 11, 2017

(54) GAMING SYSTEM AND METHOD PROVIDING A CARD GAME WITH COMBINABLE CARDS

(71) Applicant: IGT, Las Vegas, NV (US)

(72) Inventors: Christopher W. Ginac, Reno, NV (US); Gianpaulo M. Sorreta, Sparks, NV (US); Bradford D. Brown, Sparks, NV (US)

(73) Assignee: IGT, Las Vegas, NV (US)

( * ) Notice: Subject to any disclaimer, the term of this patent is extended or adjusted under 35 U.S.C. 154(b) by 150 days.

(21) Appl. No.: 14/258,558

(22) Filed: Apr. 22, 2014

(65) Prior Publication Data

US 2015/0302702 A1 Oct. 22, 2015

(51) Int. Cl.
*G07F 17/32* (2006.01)

(52) U.S. Cl.
CPC ..... *G07F 17/3293* (2013.01); *G07F 17/32* (2013.01)

(58) Field of Classification Search
CPC ..... G07F 17/3293
See application file for complete search history.

(56) References Cited

U.S. PATENT DOCUMENTS

| | | | |
|---|---|---|---|
| 4,440,398 | A | 4/1984 | Charon et al. |
| 5,022,653 | A | 6/1991 | Suttle et al. |
| 5,100,137 | A | 3/1992 | Fulton et al. |
| 5,167,413 | A | 12/1992 | Fulton et al. |
| 5,205,555 | A | 4/1993 | Hamano |
| 5,251,897 | A | 10/1993 | Fulton et al. |
| 5,322,295 | A | 6/1994 | Cabot et al. |
| 5,356,140 | A | 10/1994 | Dabrowski et al. |
| 5,374,067 | A | 12/1994 | Jones et al. |
| 5,377,973 | A | 1/1995 | Jones et al. |
| 5,380,012 | A | 1/1995 | Jones et al. |
| 5,382,025 | A | 1/1995 | Sklansky et al. |
| 5,411,257 | A | 5/1995 | Fulton et al. |

(Continued)

FOREIGN PATENT DOCUMENTS

| | | |
|---|---|---|
| AU | 1987074936 | 6/1987 |

OTHER PUBLICATIONS

Pass the Trash, webiste, http://www.pagat.com/poker/variants/passthetrash.html, Apr. 18, 2014 (6 pages).

*Primary Examiner* — James S McClellan
*Assistant Examiner* — Kevin Carter
(74) *Attorney, Agent, or Firm* — Neal, Gerber & Eisenberg LLP

(57) ABSTRACT

Various embodiments of the present disclosure are directed to a gaming system and method providing a card game wherein two or more cards of a hand of cards are combinable to form at least one resultant card with a higher combined value. In various embodiments, for a play of the card game, the gaming system randomly selects and displays a hand of cards and each card is associated with one of a plurality of different values. The gaming system enables the player to select at least two of the displayed cards to combine to form at least one resultant card. Each resultant card is associated with a resultant value. The resultant value includes the sum of the values associated with each selected card that is combined to form the resultant card. Each resultant card provides an opportunity to convert a non-winning hand into a winning hand.

35 Claims, 8 Drawing Sheets

(56) References Cited

U.S. PATENT DOCUMENTS 5,431,408 A 7/1995 Adams et al.
5,437,451 A 8/1995 Fulton et al.
5,531,448 A 7/1996 Moody et al.
5,636,842 A 6/1997 Cabot et al.
5,732,950 A 3/1998 Moody et al.
5,755,621 A 5/1998 Marks et al.
5,785,593 A * 7/1998 Wood ..... A63F 1/00 273/292
5,803,809 A 9/1998 Yoseloff
5,820,460 A 10/1998 Fulton et al.
5,823,873 A 10/1998 Moody et al.
5,833,536 A 11/1998 Davids et al.
5,882,259 A 3/1999 Holmes et al.
5,908,353 A 6/1999 Andrews
5,911,418 A 6/1999 Adams et al.
5,954,335 A 9/1999 Moody et al.
5,957,774 A 9/1999 Holmes et al.
6,007,066 A 12/1999 Moody et al.
6,050,658 A 4/2000 O'Sullivan et al.
6,062,979 A 5/2000 Inoue
6,098,985 A 8/2000 Moody et al.
6,135,883 A 10/2000 Hachquet
6,176,781 B1 1/2001 Walker et al.
6,193,235 B1 2/2001 Vancura et al.
6,196,547 B1 3/2001 Pascal et al.
6,248,016 B1 6/2001 Walker et al.
6,257,979 B1 7/2001 Walker et al.
6,311,978 B1 11/2001 Moody
6,332,839 B2 12/2001 Walker et al.
6,334,613 B1 1/2002 Yoseloff
6,402,147 B1 6/2002 Lo
6,406,023 B1 6/2002 Rowe
6,419,578 B1 7/2002 Moody et al.
6,422,940 B1 7/2002 Walker et al.
6,474,645 B2 11/2002 Tarantino
6,517,074 B1 2/2003 Moody et al.
6,523,829 B1 2/2003 Walker et al.
6,533,658 B1 3/2003 Walker et al.
6,561,898 B2 5/2003 Moody
6,568,680 B1 5/2003 Moody et al.
6,569,014 B2 5/2003 Walker et al.
6,592,456 B2 7/2003 Walker et al.
6,652,377 B1 11/2003 Moody
6,672,959 B2 1/2004 Moody et al.
6,705,943 B2 3/2004 Awada
6,726,427 B2 4/2004 Jarvis et al.
6,729,961 B1 5/2004 Millerschone
6,905,406 B2 6/2005 Kaminkow et al.
6,916,245 B1 7/2005 Vancura et al.
6,935,950 B2 8/2005 Tarantino
6,955,356 B2 10/2005 Moody
6,964,418 B2 11/2005 Moody
6,969,316 B2 11/2005 Jarvis et al.
6,991,538 B2 1/2006 Cannon
6,994,624 B2 2/2006 Gold et al.
7,056,207 B2 6/2006 Walker et al.
7,059,965 B2 6/2006 Jackson
7,137,628 B2 11/2006 Moody
7,156,397 B2 1/2007 Moody et al.
7,156,734 B1 1/2007 Walker et al.
7,201,655 B2 4/2007 Walker et al.
7,222,857 B2 5/2007 Moody
7,222,858 B2 5/2007 Moody
7,247,092 B2 7/2007 Jarvis et al.
7,264,243 B2 9/2007 Yoseloff et al.
7,297,057 B2 11/2007 Gerrard et al.
7,354,344 B2 4/2008 Paulsen et al.
7,364,162 B2 4/2008 Patelidas
7,387,568 B2 6/2008 Millerschone
7,390,258 B2 6/2008 Millerschone
7,393,276 B2 7/2008 Millerschone
7,402,102 B2 7/2008 Marks et al.
7,404,762 B2 7/2008 Moody
7,416,186 B2 8/2008 Walker et al.
7,419,162 B2 9/2008 Lancaster et al.
7,431,644 B2 10/2008 Moody
7,467,542 B2 12/2008 Elrod
7,488,251 B2 2/2009 Kaminkow
7,524,243 B2 4/2009 Bansemer et al.
7,614,946 B2 11/2009 Nicely
7,641,197 B2 1/2010 Jackson
7,658,672 B1 2/2010 Wolf et al.
7,748,714 B2 7/2010 Nicely et al.
7,749,059 B2 7/2010 Tarantino
7,749,061 B2 7/2010 Walker et al.
7,771,274 B2 8/2010 Walker et al.
7,785,188 B2 8/2010 Cannon
7,803,041 B2 9/2010 Gold et al.
7,803,043 B2 9/2010 Jackson
7,815,500 B2 10/2010 Montross et al.
7,837,545 B2 11/2010 Blair, Jr. et al.
7,857,693 B1 12/2010 Johnson et al.
7,862,417 B2 1/2011 Nicely
7,867,073 B2 1/2011 Walker et al.
7,909,690 B2 3/2011 Low
7,914,369 B2 3/2011 Walker et al.
7,918,724 B2 4/2011 Walker et al.
7,922,571 B2 4/2011 Walker et al.
7,993,191 B2 8/2011 Evans et al.
8,062,119 B2 11/2011 Stern et al.
8,083,578 B2 12/2011 Jackson
RE43,114 E 1/2012 Walker et al.
8,092,290 B2 1/2012 Darby
8,092,291 B2 1/2012 Gerrard et al.
8,100,748 B2 1/2012 Montross et al.
8,123,604 B2 2/2012 Lancaster et al.
8,137,174 B2 3/2012 Nicely et al.
8,147,310 B2 4/2012 Jarvis et al.
8,152,615 B2 4/2012 Lancaster et al.
8,157,631 B2 4/2012 Lancaster et al.
8,172,660 B2 5/2012 Lancaster et al.
8,177,616 B2 5/2012 Nicely
8,177,619 B2 5/2012 Jackson
8,197,319 B2 6/2012 Nicely
8,197,321 B2 6/2012 Wolf et al.
8,210,532 B2 7/2012 Evans et al.
8,210,533 B2 7/2012 Evans et al.
8,216,039 B2 7/2012 Nicely et al.
8,226,469 B2 7/2012 Pawloski et al.
8,231,454 B2 7/2012 Caputo
8,235,780 B2 8/2012 Nicely
8,235,781 B2 8/2012 Moody
8,262,448 B2 9/2012 Nicely et al.
RE43,822 E 11/2012 Walker et al.
8,328,614 B2 12/2012 Jones et al.
8,328,623 B2 12/2012 Stern et al.
8,353,751 B2 1/2013 Bickley et al.
8,398,472 B2 3/2013 Bansemer et al.
8,398,473 B2 3/2013 Baerlocher et al.
8,403,739 B2 3/2013 Jackson
8,408,984 B2 4/2013 Walker et al.
8,419,518 B2 4/2013 Jarvis et al.
8,425,306 B2 4/2013 Low
8,434,764 B2 5/2013 Walker et al.
8,444,465 B2 5/2013 Macaulay
8,449,362 B2 5/2013 Jackson
8,449,363 B2 5/2013 Baerlocher et al.
8,449,364 B2 5/2013 Lancaster et al.
8,475,253 B1 7/2013 Cole
8,475,255 B2 7/2013 Wolf et al.
8,485,880 B2 7/2013 Nicely
8,491,375 B2 7/2013 Low
8,622,809 B1 1/2014 Arora et al.
2005/0227754 A1 10/2005 Kaminkow et al.
2006/0052157 A1* 3/2006 Walker ..... G07F 17/3227 463/25
2008/0111309 A1 5/2008 Nicely et al.
2008/0188278 A1 8/2008 Paulsen et al.
2008/0254847 A1 10/2008 Millerschone
2010/0004051 A1 1/2010 Walker et al.
2010/0099480 A1 4/2010 Caputo
2010/0120484 A1 5/2010 Caputo et al.
2010/0227661 A1 9/2010 Walker et al.
2011/0014963 A1 1/2011 Walker et al.

(56) References Cited

U.S. PATENT DOCUMENTS

| | | | | |
|---|---|---|---|---|
| 2011/0049806 | A1* | 3/2011 | Haddad | G07F 17/32 273/292 |
| 2011/0111818 | A1 | 5/2011 | Baerlocher | |
| 2012/0122534 | A1 | 5/2012 | Montross et al. | |
| 2012/0149451 | A1 | 6/2012 | Nicely et al. | |
| 2012/0270622 | A1 | 10/2012 | Pawloski et al. | |
| 2012/0276971 | A1 | 11/2012 | Nicely et al. | |
| 2012/0282996 | A1 | 11/2012 | Nicely et al. | |
| 2012/0295683 | A1 | 11/2012 | Moody | |
| 2012/0329543 | A1 | 12/2012 | Nicely et al. | |
| 2013/0172064 | A1 | 7/2013 | Bansemer et al. | |
| 2013/0172065 | A1 | 7/2013 | Jackson | |
| 2013/0217457 | A1 | 8/2013 | Jarvis et al. | |
| 2013/0231170 | A1 | 9/2013 | Macaulay | |
| 2013/0231176 | A1 | 9/2013 | Walker et al. | |

* cited by examiner

GAMING SYSTEM AND METHOD PROVIDING A CARD GAME WITH COMBINABLE CARDS

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

In recent years, poker has become very popular. One of the most common variations of poker is Five Card Draw. In general, in Five Card Draw poker the player receives five cards dealt face up from a fifty-two card deck of playing cards. The player can discard none, one, a plurality, or all of the five cards. Each discarded card is replaced with another card from the deck. After the replacement (if any), the cards are evaluated for winning combinations. For a five-card poker game, there are typically ten general categories of hands, ranked from highest to lowest, as shown in Table 1 below.

TABLE 1

Ranking of Five Card Poker Hands by Category

| Rank | Name | Example |
|---|---|---|
| 1 | Royal Straight Flush | A♣K♣Q♣J♣10♣ |
| 2 | Straight Flush | K♣Q♣J♣10♣9♣ |
| 3 | Four of a Kind | J♣J♥J♦J♠3♣ |
| 4 | Full House | A♥A♦A♣6♦6♣ |
| 5 | Flush | A♣J♣8♣6♣2♣ |
| 6 | Straight | 8♦7♣6♠5♠4♣ |
| 7 | Three of a Kind | Q♠Q♥Q♦6♦2♠ |
| 8 | Two Pair | 8♦8♥5♥5♣2♠ |
| 9 | One Pair | K♦K♠8♣7♣2♥ |
| 10 | High Card | A♥10♣7♦5♠3♠ |

Within each category, hands are ranked according to the rank of individual cards, with an Ace being the highest card and a Two being the lowest card. There is no difference in rank between the four suits of cards. All hands can be ranked in a linear ranking from highest to lowest. Because suits are all of the same value, however, there are multiple hands that have identical rankings. For example, there are four equivalent hands for each type of Straight Flush, Four of a Kind, or Flush. There are over a hundred equivalent hands for each Two Pair variation, and there are over 1,000 equivalent hands for each type of no-pair hand.

Numerous variations of poker exist, including Five Card Draw as mentioned above, Three Card Poker, Five Card Stud, Seven Card Stud, Hold 'Em (also called Texas Hold 'Em), Omaha (also called Omaha Hold 'Em), and Pai-Gow Poker. These games generally differ in the manner in which cards are dealt and in the manner and frequency in which bets are placed. Various criteria may also be used to determine the winning hand, including the highest ranking hand, the lowest ranking hand (Low-Ball), and where the highest ranking and lowest ranking hands each win half of the pot (High-Low).

In certain known multiplayer variations of poker, players play against each other rather than against a dealer or house.

In certain of these variations, a round of play begins when each player has placed an initial bet, which is typically referred to as the ante, into the pot. The term pot typically refers to the total accumulation of antes and wagers made during a particular game. In other poker variations, such as Texas Hold 'Em (described in further detail below), only two players at a table make the initial bets, which are commonly referred to as the blinds.

The quantity of cards dealt depends on the particular variation of poker being played. For example, in Five Card Draw, each player is initially dealt five cards. In typical Three Card Poker games where the player plays against a dealer hand, the player is dealt a total of three cards and the dealer hand includes a total of three cards as well. In certain known Three Card Poker games, the initially dealt player hand and dealer hand are final and there is no option to replace or draw any new cards. In Texas Hold 'Em, Five Card Stud and Seven Card Stud, each player is initially dealt two cards. These cards are typically dealt face-down. However, depending on the game, some of the cards may be dealt face-up to the player. For example, in certain versions of Five Card Stud, each player is initially dealt one card face-up and one card face-down. In Texas Hold 'Em, each player is initially dealt two cards face-down, which are commonly referred to as the hole cards.

For certain poker variations in which additional cards are dealt or in which cards may be replaced, after the initial deal, a first round of wagering begins, in which the players have the opportunity to place wagers. If a player places a wager, that wager must be matched (i.e., called) or raised by each player that wants to remain in the game. A raise includes matching the previous wager and increasing the total bet. A player who does not match a bet drops out of the game or folds. A round of betting ends when either every player but one has folded, or when the highest bet or raise has been called by at least one remaining player such that each remaining player has wagered the same amount into the pot during the round.

Depending on the variation of poker being played, each game may have only an initial wager or several rounds of wagering, where each round of wagering is generally preceded by the dealing of one or more cards. A player wins a game of poker by being the last remaining player in the game after all other players have folded or by having the highest ranking hand when a showdown occurs. If two or more players remain after the final round of wagering is complete, a showdown occurs. During the showdown, each remaining player's hand is displayed, the highest ranking hand is determined to be the winning hand, and the pot is provided to the player having the winning hand. If two or more players have identically ranked hands that are the highest ranking hands, the pot is split evenly among the tying players.

Of the poker variations mentioned above, Texas Hold 'Em is one of the more popular versions. Texas Hold 'Em is generally a multi-player card game played at a live card table or via a computer-based virtual card table. In one version of a live card table game of Texas Hold 'Em, only two players at a table make the initial bets, commonly referred to as the blinds. The blinds include a big blind and a small blind. The big blind is typically twice the value of the small blind. In a blind-based game such as Texas Hold 'Em, all players are initially eligible to receive a hand, even if they do not place the big blind or the small blind. After the players have anted (if an ante is required), each player eligible for play is dealt an initial set of cards. Each of the players must match the blinds, raise the blinds or fold. Texas Hold 'Em includes a designated quantity of community cards (usually five) that can be used by all of the players in combination with their hole cards. However, in certain variations, there may only be three community cards. In certain Texas Hold 'Em games, the community cards are dealt over the course of several wagering rounds. For example, the gaming device or dealer deals the flop (usually three cards), the turn (usually one card), and the river (usually one card). The winning hand is the resulting five card hand (of the combined seven cards) having the highest poker rank. This method of determining a winning five card hand is similar to determining a winning hand in Seven Card Stud. However, Seven Card Stud does not utilize community cards as in Texas Hold 'Em. In other variations of Texas Hold 'Em, where the quantity of community cards is only three, the flop is a single card rather than three cards.

There is a continuing need for new and exciting poker games to keep players engaged during game play, increase entertainment value, and provide additional excitement to players.

SUMMARY

Various embodiments of the present disclosure are directed to a gaming system and method providing a card game wherein two or more cards of a hand of cards are combinable to form at least one resultant card with a higher combined value.

In various embodiments, for a play of the card game, the gaming system randomly selects and displays a hand of cards from a virtual deck of cards. Each card of the deck of cards is associated with one of a plurality of different values. The gaming system determines whether the displayed hand of cards includes any designated card combinations. In one embodiment, the designated card combinations are any winning card combinations. In this embodiment, if the displayed hand of cards includes one or more winning or designated card combinations, the gaming system determines any award associated with the winning card combination and displays and provides any determined award. If the displayed hand of cards does not include any designated or winning card combinations, the gaming system enables the player to select at least two of the displayed cards of the displayed hand of cards to combine to form at least one resultant card. Each resultant card is associated with a resultant value. In this embodiment, the resultant value includes the sum of the values associated with each selected card that is combined to form the resultant card. In this embodiment, the gaming system displays the resultant value associated with the resultant card. Thus, the gaming system enables the player to combine the at least two cards to form a resultant card associated with a higher combined value for an opportunity to convert a non-winning hand into a winning hand. The gaming system then evaluates any displayed unselected cards and any resultant cards for any winning card combination. If the evaluated cards include any winning card combination, the gaming system displays and provides the player any award associated with the winning card combination.

More specifically, in one example embodiment, the gaming system: (a) randomly selects a hand of five cards from a virtual standard deck of 52 cards, wherein each card is associated with a value (i.e., 1, 2, 3, 4, 5, 6, 7, 8, 9, 10, 11, 12, 13, and 14); (b) displays the randomly selected hand of cards; and (c) determines whether the displayed hand of cards includes any designated card combinations. In this example embodiment, the designated card combination is any winning card combination based on a first paytable. If the displayed hand includes any winning card combination, the gaming system determines any award associated with the winning card combination and displays and provides the determined award.

If the displayed hand of cards does not include a winning card combination, then the displayed hand of cards does not include one of the designated card combinations, and the gaming system enables the player to combine two or more cards to form a resultant card. More specifically, in this example, the gaming system enables the player to select at least two of the displayed cards to combine to form at least one resultant card. The gaming system determines a resultant value associated with each resultant card by determining a sum of the values associated with each selected card that is combined by the player to form the resultant card. It should be appreciated that each card is also associated with one of a plurality of different suits. In this embodiment, the suits are not relevant for the formation of a resultant card by the combination of cards. Any card is combinable with any other card regardless of the suit associated with each card. In certain alternative embodiments, the suit associated with each card is relevant for the combination of cards. In one example alternative embodiment, only cards associated with the same suit are combinable with one another to form a resultant card.

The gaming system evaluates any resultant cards and any unselected displayed cards from the hand of cards for any winning card combinations based on a second paytable. For any winning card combinations, the gaming system displays and provides any award associated with the winning card combination.

It should be appreciated that in this embodiment, the gaming system uses a first paytable to determine whether the displayed hand of cards without any resultant cards includes a designated winning card combination and a second paytable to evaluate the unselected cards and the resultant cards. As will be discussed in greater detail below, in certain embodiments, the first and second paytables are the same. In certain alternative embodiments, the first and second paytables are different.

It should be appreciated from the embodiment described above, that the resultant card is formed by combining two or more cards, and the resultant value includes the sum of the values associated with the cards combined to form the resultant card. In certain alternative embodiments, the resultant value is the result of a different mathematical operation including but not limited to subtraction, multiplication, and/or division of the values associated with each of the cards combined to form the resultant card.

The present disclosure thus enables a player to convert a non-winning hand into a winning hand. Such a configuration provides a player an opportunity to combine cards into a higher value for a chance to achieve a win that the player would not have originally won. The present disclosure provides a new and exciting card game that keeps players engaged during game play, increases entertainment value, and provides additional player excitement.

Additional features and advantages are described herein, and will be apparent from, the following Detailed Description and the Figures.

DETAILED DESCRIPTION

Card Game with Combinable Cards

Various embodiments of the present disclosure are directed to a gaming system and method providing a card game wherein two or more cards of a hand of cards are combinable to form a resultant card with a higher combined value. In various embodiments, for a play of the card game, the gaming system randomly selects and displays a hand of cards from a virtual deck of cards, wherein each card of the deck of cards is associated with one of a plurality of different values. If the hand of cards does not include any designated card combinations, the gaming system enables the player to select at least two of the displayed cards of the displayed hand of cards to combine to form a resultant card. Each resultant card is associated with a resultant value. The gaming system evaluates any displayed unselected cards and any resultant cards for any winning card combination and displays and provides the player any award associated with the winning card combination.

While the card game of the present disclosure is employed as a base or primary game in the embodiments described below, it should be appreciated that the card game may additionally or alternatively be employed as or in association with a bonus game or a secondary game. Moreover, while any credit balances, any wagers, and any awards are displayed as amounts of monetary currency, credits, or "chips" representing monetary currency or credits in the embodiments described below, one or more of such credit balances, such wagers, and such awards may be for non-monetary credits, promotional credits, player tracking points or credits, or chips representing any thereof.

In certain of the example embodiments described below, while the example card games are variations of stud poker games, it should be appreciated that the present disclosure contemplates employing any other suitable type of card game instead of or in addition to stud poker games such as draw poker games.

Figure 1:
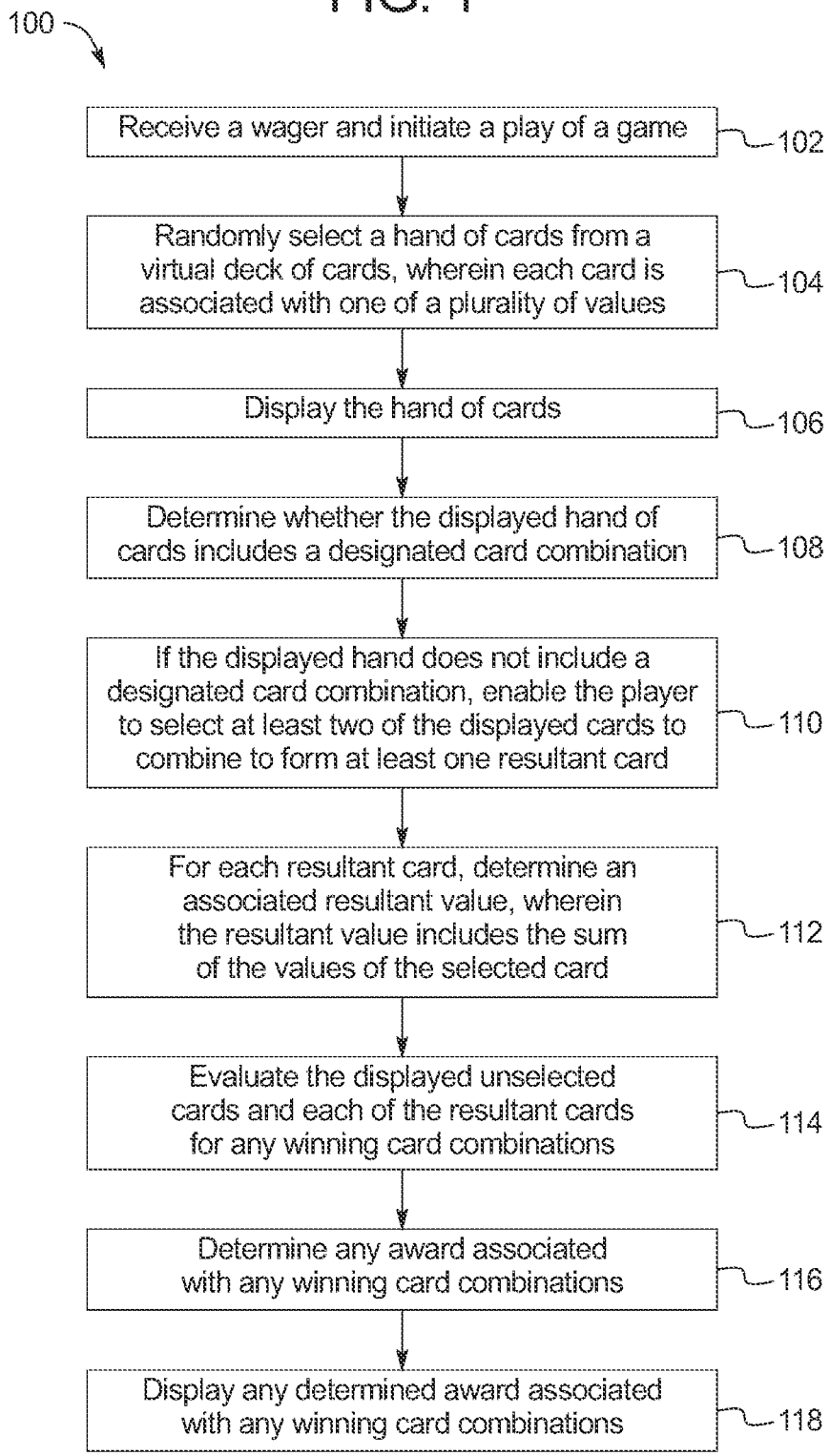
FIG. 1 is a flowchart illustrating a method of operating an example embodiment of the gaming system of the present disclosure configured to operate the card game wherein two or more cards of a hand of cards are combinable to form a resultant card with a higher combined value.

Referring now to FIG. 1, which illustrates a flowchart of an embodiment of a process for operating a gaming system disclosed herein. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain of the illustrated blocks and/or diamonds may be changed, certain of the illustrated blocks and/or diamonds may be optional, and/or certain of the illustrated blocks and/or diamonds may not be employed.

In operation of this embodiment, the gaming system receives a wager from a player for a play of the card game as indicated by block 102. After receiving the wager, the gaming system randomly selects a hand of cards from a standard virtual deck of 52 cards, wherein each card is associated with one of a plurality of values as indicated by block 104. In this example, for the cards of a traditional deck ranging from 2 to 10, the value associated with the card is the numerical value shown on the face of the card. For example, the 2♦, 2♠, 2♣ and 2♥ all are associated with a value of 2. In this example, each Jack is associated with a value of 11, each Queen is associated with a value of 12 and each King is associated with a value of 13. The Ace, in this example, is associated with two different values: (1) an additive value; and (2) an evaluation value at the same time depending on the manner in which it is being used. The additive value is the value associated with the Ace for purposes of combining the Ace with another card, as will be described in greater detail below. In this example, the Ace has an additive value of one. The evaluation value is the value associated with the Ace when determining whether the displayed cards include a winning card combination. When evaluating any card combination to determine a game outcome, as will be described in greater detail below, an Ace is associated with an evaluation value of fourteen.

It should be appreciated that each card is also associated with one of a plurality of different suits. In this embodiment, the suit associated with each card is not relevant for the combination of cards. Thus, in this embodiment, any displayed card is combinable with any other displayed card regardless of the suit associated with either card. Because the suit is not relevant for the combination of cards in this embodiment, the combined resultant card is not associated with any of the plurality of different suits or the suit is not relevant for evaluation purposes. In certain alternative embodiments, only cards associated with the same suit are combinable with one another. In such an embodiment, the resultant card is also associated with the suit of the cards combined to form the resultant card. In other alternative embodiments, only cards associated with suits of the same color (i.e., hearts and diamonds or spades and clubs) are combinable with one another. In another alternative embodiment, cards associated with a different combination of suits are combinable, such as for example hearts and spades or diamonds and clubs, or any other combination thereof. In certain embodiments, the combination of combinable suits is predetermined. In other alternative embodiments, the number of suits that are combinable is based on the wager placed by the player.

After randomly selecting a hand of cards, the gaming system displays the hand of cards face up, as indicated by block 106. The gaming system determines whether the displayed hand of cards includes a designated card combination as indicated by 108. In this example, the designated card combinations are all winning card combinations. That is, in this example, the gaming system determines whether the displayed hand of cards includes any winning card combination based on a standard five-card Jacks or Better paytable. If the displayed hand of cards includes a designated or winning card combination, the gaming system determines any award associated with the winning card combination and displays and provides the determined award. Upon displaying and providing the determined award to the player, in this example, the gaming system ends the play of the game.

If the gaming system determines that the displayed hand of cards does not include a designated card combination (i.e., does not include any winning card combinations), then the gaming system enables the player to form a resultant card. More specifically, the gaming system enables the player to select at least two of the displayed cards to combine to form at least one resultant card as indicated by block 110. In this embodiment, as described above, the suit associated with each card is not relevant for combination or evaluation purposes. In this embodiment, any displayed card is combinable with any other displayed cards, and the resultant card formed from the combination is not associated with a suit for evaluation purposes.

For each resultant card, the gaming system determines a resultant value associated with the resultant card, as indicated by block 112. The resultant value associated with each resultant card includes the sum of the values associated with each card combined to form the resultant card. In this example, the resultant value is the sum of the values associated with the cards selected to form the resultant card. It should be appreciated, that the gaming system enables the player to form a resultant card associated with a higher combined value so that the player has another opportunity to form a winning card combination.

In one example, the gaming system displays a hand of five cards including the A♥, K♣, J♦, 9♠ and 2♥. The gaming system enables the player to select to combine the J♦ and the 2♥ to form a resultant card. In this example, the resultant value is the sum of the values associated with the cards combined to form the resultant card. In this example, the resultant value is thirteen, which is the value of a King. The displayed unselected cards and the newly formed resultant card include a winning card combination of a pair of Kings. In another example embodiment, the gaming system displays a hand of five cards including A♥, K♣, 8♦, 2♠, and 4♥. In this example, the gaming system enables the player to select three cards to form a resultant card. In this example, the player selects to combine the 8♦, 2♠, and 4♥ to form a resultant card. The resultant value associated with the resultant card of this example, is fourteen, which is the value of an Ace. The displayed unselected cards and the newly formed resultant card include a winning card combination of a pair of Aces. It should be appreciated that in this example, the gaming system enables the player to select more than two cards to combine to form a resultant card. It should also be appreciated that in this example, the gaming system enables the player to form more than one resultant cards by selecting multiple cards to combine. In another example embodiment, the gaming system displays an initial hand of five cards including J♥, K♣, 9♦, 2♠, and 4♥. In this example, the gaming system enables the player to select to combine the J♥ and the 2♠ to form a first resultant card associated with a resultant value of thirteen. In this example, the gaming system also enables the player to select to combine the 9♦ and the 4♥ to form a second resultant card associated with a resultant value of thirteen. Thus, the gaming system determines that the displayed unselected cards and the two resultant cards include a winning card combination of three-of-a-kind including three Kings.

In this example, the gaming system displays the resultant card by replacing the display of the cards selected to form the resultant card with a card labeled "Resultant Card" and displaying the associated resultant value on the face of the Resultant Card. It should be appreciated that the display of the resultant card could be done in a plurality of different ways.

As described above, the gaming system evaluates the displayed unselected cards and each of the resultant cards for any winning card combinations as indicated by block 114. It should be appreciated that in this example, the gaming system evaluates the unselected cards and the resultant cards based on the same standard Jacks or Better paytable used to evaluate the hand of cards prior to combining any cards. It should also be appreciated that by combining cards, certain of the five card winning card combinations are not possible in this example. It should further be appreciated that in certain alternative embodiments, as will be described in greater detail below, the gaming system uses a different modified paytable to evaluate a hand of cards including any resultant cards.

The gaming system determines any award associated with any winning card combination, as indicated by block 116, and displays and provides any determined award, as indicated by block 118. It should be appreciated that for each play of the card game, for a non-winning card combination, the gaming system provides an opportunity to combine cards for a higher value and an opportunity to obtain a winning card combination. Thus, the gaming system provides the player multiple opportunities to obtain a winning hand. The present disclosure provides a game that keeps players excited and engaged.

Figure 2A:
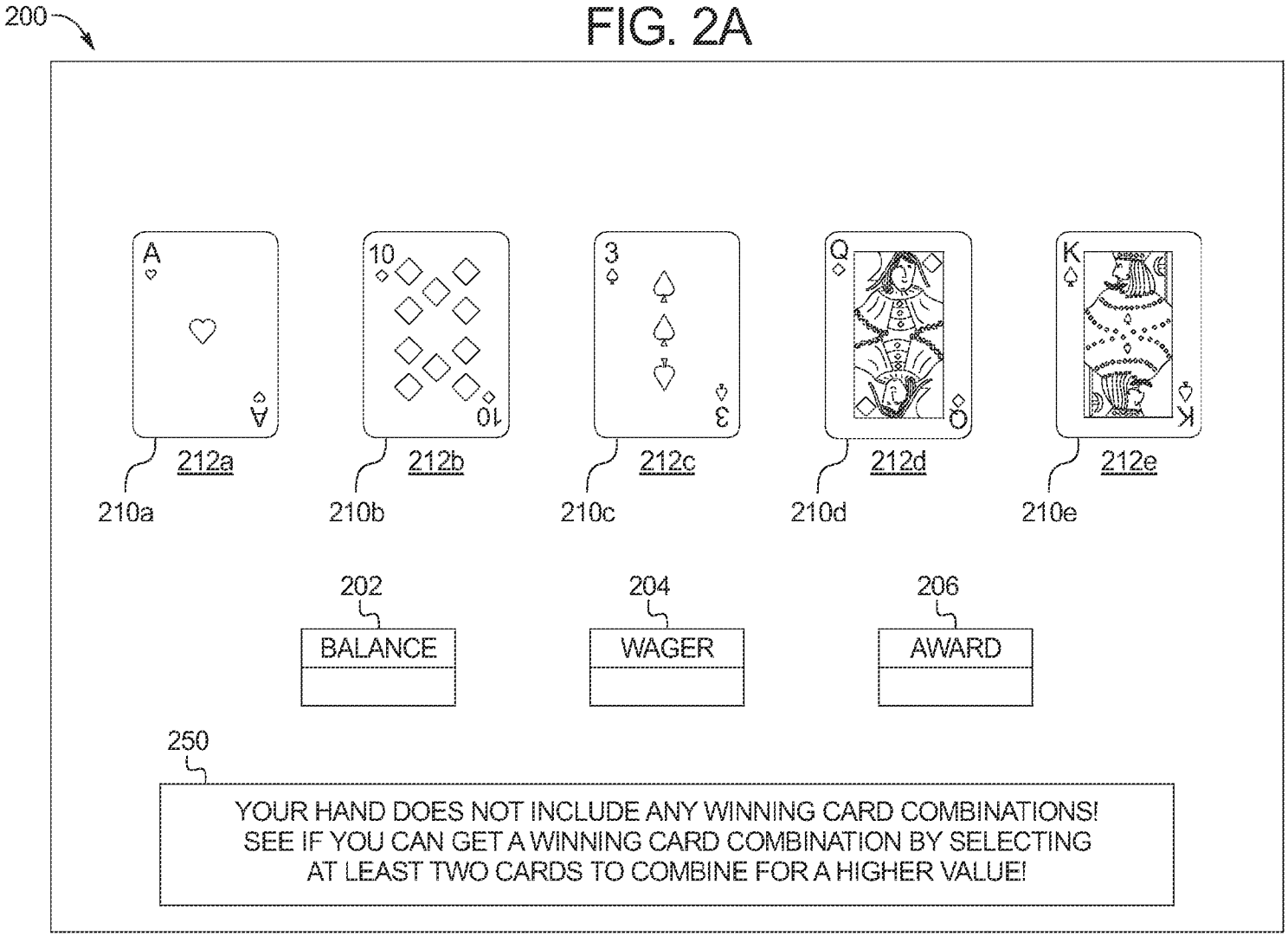
FIGS. 2A, 2B, and 2C illustrate screen shots of an example of one embodiment of the gaming system of the present disclosure providing a play of the card game wherein at least two cards of a hand of cards are combinable to form a resultant card with a higher combined value according to the method of FIG. 1.
Figure 2B:
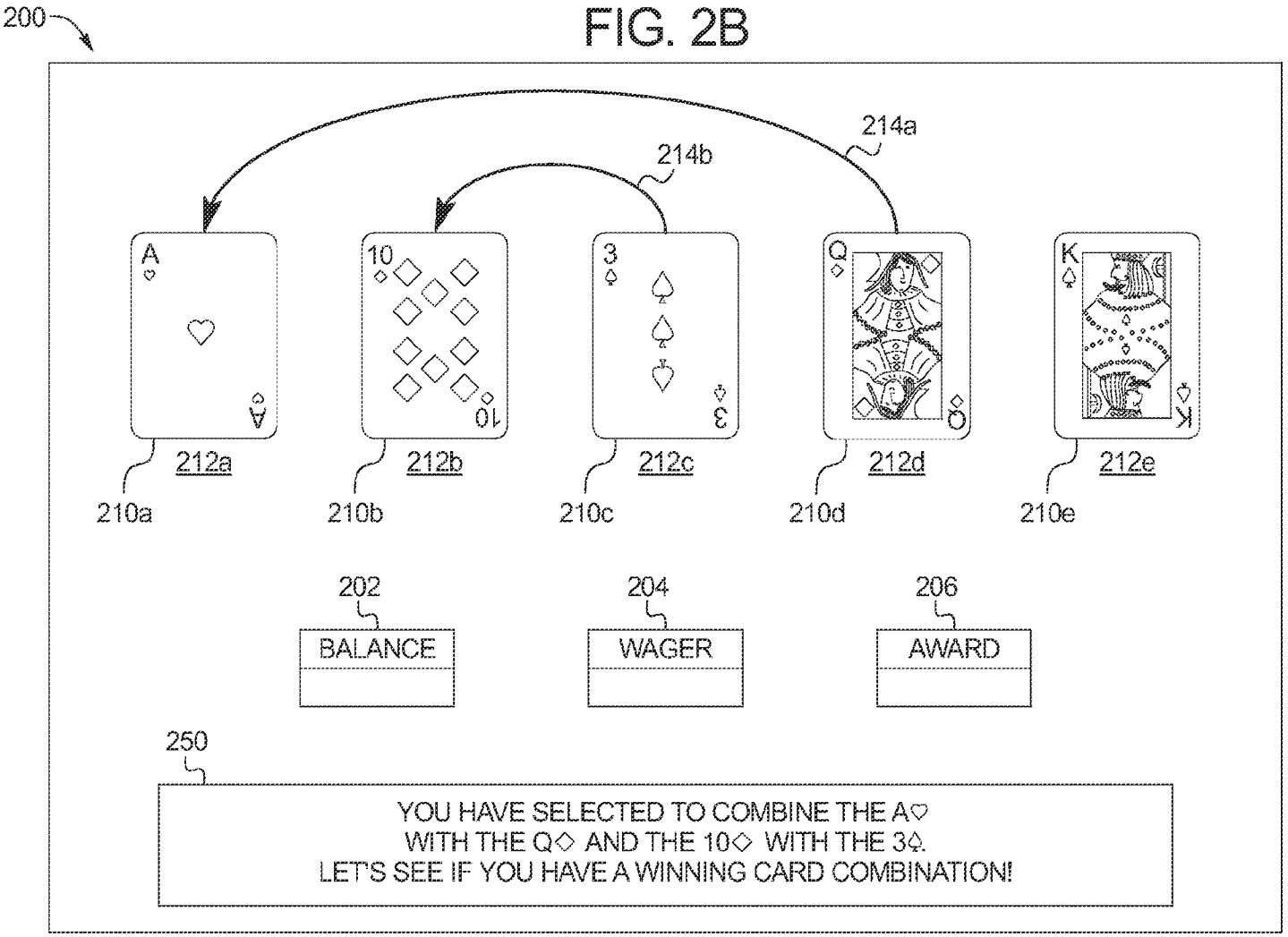
Figure 2C:
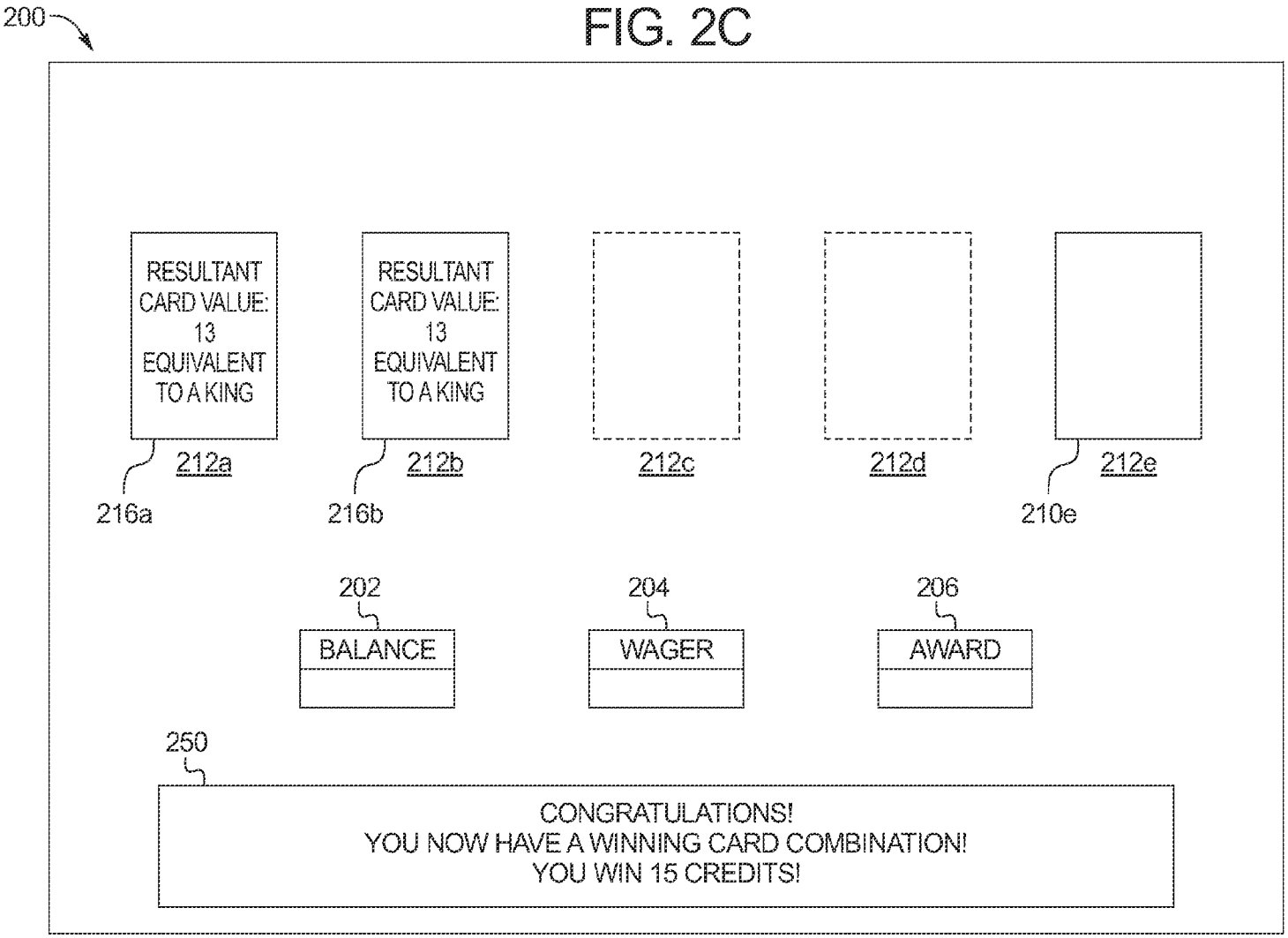

Turning now to FIGS. 2A, 2B, and 2C, which illustrate screen shots of one example embodiment of the gaming system of the present disclosure operating a card game wherein two or more cards of a hand of cards are combinable to form a resultant card with a higher combined value, as described above with respect to FIG. 1. In this example embodiment, the gaming system displays: (a) a plurality of meters including: (i) a credit meter 202 that displays the player's credit balance (in credit or currency form), (ii) a wager or bet meter 204 that displays any wager or bet placed on a play of the game (in credit or currency form), and (iii) an award meter 206 that displays any awards won for the play of the game (in credit or currency form); and (b) a message box 250 that displays a variety of messages or indications before, during, or after play of the game.

As illustrated in FIG. 2A, in this embodiment, the gaming system receives a wager to initiate a stud poker card game, as indicated by 204. Upon receiving the wager from a player for a play of the card game, the gaming system of this example randomly selects a hand of cards 210 including five cards 210*a*, 210*b*, 210*c*, 210*d*, and 210*e* from a virtual deck of 52 cards and displays the first hand of cards 210 face up as shown in the display 200 at positions 212*a*, 212*b*, 212*c*, 212*d*, and 212*e*. More specifically, in this example embodiment, the gaming system displays the hand of cards including the: A♥, 10♦, 3♠, Q♦, and K♠ as indicated by 210*a*, 210*b*, 210*c*, 210*d* and 210*e*. In this example, each numerical card is associated with the numerical value on the face of the card. Thus, the 10♦ 210*b* is associated with a value of ten, and the 3♠ 210*c* is associated with a value of three. As for the face cards, the Q♦ 210*d* is associated with a value of twelve, and K♠ 210*e* is associated with a value of thirteen. The A♥ 210*a* is associated with two different values: (a) an additive value of one, and (b) an evaluation value of fourteen in this example embodiment. The gaming system determines that the displayed hand of cards does not include any winning card combination based on a standard five-card Jacks or Better paytable as shown below. The gaming system displays the following message in the message box

250: "YOUR HAND DOES NOT INCLUDE ANY WINNING CARD COMBINATIONS! SEE IF YOU CAN GET A WINNING CARD COMBINATION BY SELECTING AT LEAST TWO CARDS TO COMBINE FOR A HIGHER VALUE!"

TABLE 2

Example Jacks or Better Paytable

| | 1 Credit | 2 Credits | 3 Credits | 4 Credits | 5 Credits |
|---|---|---|---|---|---|
| Royal Rush | 250 | 500 | 750 | 1000 | 4000 |
| Straight Rush | 50 | 100 | 150 | 200 | 250 |
| Four of a Kind | 25 | 50 | 75 | 100 | 125 |
| Full House | 9 | 18 | 27 | 36 | 45 |
| Rush | 6 | 12 | 18 | 24 | 30 |
| Straight | 4 | 8 | 12 | 16 | 20 |
| Three of a Kind | 3 | 6 | 9 | 12 | 15 |
| Two Pair | 2 | 4 | 6 | 8 | 10 |
| Jacks or Better | 1 | 2 | 3 | 4 | 5 |

Turning now to FIG. 2B, since the first hand of cards does not include a winning card combination, the gaming system enables the player to select at least two cards to combine to form at least one resultant card. In this example, the gaming system enables the player to form multiple resultant cards. In this example embodiment, the player indicates the selected cards by touching and dragging a first selected in a first position card to a second selected card at a second position as indicated by the arrows 214*a* and 214*b*. The player, in this example, selects to combine the A♥ 210*a* with the Q♦ 210*d* to form a first resultant card. The player does so by dragging the Q♦ from position 212*d* to position 212*a* as indicated by the arrow 214*a*. The player, in this example also selects to combine the 10♦ 210*b* with the 3♠ 210*c* to form a second resultant card. The player does so by dragging the 3♠ from position 212*c* to position 212*b*, as indicated by the arrow 214*b*. It should be appreciated that in this example, the gaming system enables the player to combine cards associated with different suits. It should also be appreciated that in this example embodiment, the resultant card is not associated with any specific suit. The gaming system displays the following message in the message box 250: "YOU HAVE SELECTED TO COMBINE THE A♥ WITH THE Q♦ AND THE 10♦ WITH THE 3♠. LET'S SEE IF YOU HAVE A WINNING CARD COMBINATION!"

Turning now to FIG. 2C, the resultant card 216*a* replaces the A♥ 210*a* and the Q♦ 210*d* and is displayed at position 212*a*. The resultant card 216*b* replaces the 10♦ 210*b* and the 3♠ 210*c* and is displayed at position 212*b*. For each resultant card, the gaming system determines a resultant value associated with the resultant card. The resultant value, in this example, is the sum of the values of the cards selected to combine to form the resultant card. For the first resultant card 216*a*, the A♥ is associated with an additive value of one and the Q♦ is associated with a value of twelve. The sum of the values associated with the A♥ and Q♦ is thirteen. The resultant value associated with the first resultant card is thirteen. For the second resultant card 216*b*, the 10♦ is associated with a value of ten and the 3♠ is associated with a value of three. The sum of the values associated with the cards selected to form the second resultant card 216*b* is also thirteen.

The gaming system evaluates any displayed unselected cards and any resultant cards for any winning card combinations. In this example, there is one displayed unselected card, the K♠ as indicated by 210*e* displayed at position 212*e*, and the first resultant card 216*a* is displayed at 212*a*, and the second resultant card 216*b* is displayed at 212*b*. The K♠ is associated with a value of thirteen. As described above, the first resultant card and the second resultant card are each associated with a resultant value of thirteen. The gaming system determines that the unselected displayed card and the resultant cards form a three of a kind winning card combination. In this example, three cards associated with a value of thirteen are equivalent to three Kings. Thus, the gaming system determines the award associated with the three King winning card combination, and the gaming system displays and provides the award associated with the winning card combination, as indicated by the award meter 206. The gaming system displays the following message in the message box 250: "CONGRATULATIONS! YOU NOW HAVE A WINNING CARD COMBINATION! YOU WIN 15 CREDITS!"

It should be appreciated by the example embodiment described above, that the gaming system enabled the player to convert a non-winning card combination into a winning card combination. In this embodiment, the gaming system enabled the player to form more than one resultant card. It should be appreciated that in an alternative embodiment where the gaming system enables the player to form one resultant card, using the example embodiment above, the player still could have formed a single resultant card associated with a value of thirteen for a winning card combination of a pair of Kings.

It should be appreciated that in this example embodiment, the gaming system determines the game outcome based on a three card hand. In certain alternative embodiments such as for a draw poker card game, as will be discussed in greater detail below, the gaming system enables the player to hold and replace cards for a complete hand of five cards after enabling the player to combine cards and before determining a game outcome. In certain alternative embodiments, as will be described in greater detail below, the gaming system determines the game outcome based on a different modified paytable for a reduced number of cards.

Wager for the Combining Cards

In the example described above with respect to FIGS. 2A to 2C, the main wager for the primary card game funds the base game and the combining cards feature. In various alternative embodiments, the gaming system requires a separate wager for the primary or base game and a separate secondary or side wager for providing the combining cards feature. In one embodiment, the combining cards feature may additionally or alternatively be employed as or in association with a bonus game or a secondary game upon receiving a side bet in addition to the primary wager for the base game. In one such embodiment, a player must place or wager a side bet to be eligible to receive the combing cards feature associated with the side bet. In an alternative embodiment, the player must place a maximum wager for the primary game and a side wager to be eligible for the combining cards feature. In an alternative embodiment, one side wager funds the combining cards feature for multiple hands of cards.

Paytables

In various embodiments of the present disclosure the gaming system provides any one of a plurality of different paytables for the present disclosure. In the example embodiments described above with reference to FIGS. 2A, 2B and 2C, the gaming system determined whether the hand of cards included a designated card combination prior to forming any resultant cards based on a standard five-card Jacks or Better paytable. In that example, the gaming system evaluated the resultant cards and any unselected cards based on the same standard five-card Jacks or Better paytable. It should be appreciated that after forming a resultant card by combining two cards, without an opportunity to draw additional cards, the determined game outcome is based on a four-card hand. Thus, certain winning card combinations of the Jacks or Better paytable are not possible for a four-card hand.

In certain alternative embodiments, the gaming system uses a first paytable to evaluate the hand of cards before any cards are combined and a second different paytable for the hand of cards after any cards are combined to form a resultant card. More specifically, in one example embodiment, the gaming system evaluates the hand of cards including any resultant cards based on a different modified paytable. In one embodiment, the modified paytable is a paytable based on a reduced number of cards in a hand of cards. In certain alternative embodiments, the modified paytable for a hand of cards including any resultant cards has a different average expected payout than a paytable for a hand of cards not including any resultant cards.

Draw Poker Variation

In the example embodiments described above, the gaming system employs a stud poker type base game. In various alternative embodiments of the present disclosure, the gaming system employs a draw poker type base card game for one or more plays of the card game of the present disclosure.

More specifically, in one example embodiment, for a play of the card game, the gaming system: (a) randomly selects a first hand of five cards from a first virtual deck of cards; (b) displays the first hand of five cards face up; (c) enables the player to select which cards to hold; (d) discards the remaining cards; and (e) replaces each discarded card with a replacement card from the virtual deck of cards to form a second hand of cards. In one embodiment, the gaming system then determines whether the second hand of cards includes a designated card combination. If the second hand of cards does not include a designated card combination, the gaming system enables the player to select at least two cards from the second hand of cards to combine to form at least one resultant card. The gaming system evaluates any unselected cards and any resultant cards for any winning card combination. The gaming system determines any award associated with any winning card combination, and displays and provides any determined award.

In certain alternative embodiments, the gaming system enables the player to form resultant cards only from the replacement cards of the second hand of cards. More specifically, after the gaming system enables the player to select which cards to hold, and replaces any discarded cards, the gaming system enables the player to select from the replacement cards to form a resultant card. In this draw poker embodiment, the gaming system does not allow the player to combine any cards held from the first hand of cards.

In another alternative embodiment of the present disclosure, the gaming system enables the player to combine cards after the gaming system displays the first hand of cards and prior to selecting which cards of the first hand of cards to hold. More specifically, in one example embodiment, the gaming system randomly selects a first hand of cards including Q♣, 6♥, 10♦, 2♠, and 5♣. In this example, the player selects to combine the 10♦ and 2♠ to form a resultant card associated with a resultant value of twelve, which is the value associated with a Queen. Thus, in this example, after combining the 10♦ and the 2♠, the first hand of cards includes a resultant card associated with the value of a Queen, Q♣, 6♥, and 5♣. In this example embodiment, the gaming system enables the player to select which cards of the Q♣, 6♥, 5♣, and the resultant card to hold. The player selects to hold the Q♣ and the resultant card associated with a value of a Queen. The gaming system discards the remaining cards, 6♥, and 5♣, and replaces the discarded cards with two replacement cards from the virtual deck of cards to form a second hand of cards. It should be appreciated that by replacing two cards, the second hand of cards includes four cards.

In certain alternative embodiments, the gaming system replaces any discarded cards and any cards combined to form resultant cards for a complete second hand of five cards. It should be appreciated that in this example, after the gaming system enables the player to combine cards during for the first hand, the remainder of the game is standard video poker. It should also be appreciated that this example allows for standard wins plus five-of-a-kind wins.

In various alternative embodiments, the gaming system enables the player to form at least one resultant card for both the initial hand of cards before the draw phase and for the final hand of cards after the draw phase. In certain alternative embodiments, the gaming system enables the player to draw additional cards after forming the at least one resultant card for a complete hand of five cards to allow for standard wins plus five-of-a-kind wins. In certain alternative embodiments, the gaming system allows for multiple resultant cards after cards are drawn again.

In certain alternative embodiments, the gaming system enables the player to either select to combine at least two cards, or to select to hold any cards for the second hand of cards. More specifically, in one embodiment, the gaming system does not enable the player to both select two or more cards to combine, and select one or more cards to hold. Thus, the player must make a choice after the gaming system displays the first hand of cards and before the player selects any cards to hold, whether the player wants to combine any cards.

Designated Card Combinations

In various embodiments of the present disclosure, the gaming system enables the player to combine two or more cards to form a resultant card if the gaming system determines that the hand of cards does not include one of the designated card combinations. In the example embodiment described above with reference to FIGS. 2A to 2C, the designated card combinations are all winning card combinations. If the displayed hand of cards does not include a designated or winning card combination, the gaming system enables the player to combine two or more cards for an additional opportunity to obtain a winning hand. Thus, the gaming system provides an opportunity to convert a non-winning hand into a winning hand by enabling the player to form a resultant card associated with a resultant value.

In certain alternative embodiments, the designated card combination includes certain predefined winning card combinations. More specifically, in one embodiment, all winning card combinations are associated with a specific rank such that the winning card combination associated with the highest award is associated with the highest rank. In an example of this embodiment, the designated card combinations include all card combinations above a certain rank. In this example embodiment, for a hand of cards that does not include a designated card combination (i.e., a hand of cards that does not include winning card combinations above a certain rank) the gaming system enables the player to select two or more cards to combine. Thus, in this example, the gaming system provides an opportunity to improve a winning hand into a winning hand associated with a greater award.

In certain alternative embodiments, there is no designated card combination. More specifically, in certain embodiments, the gaming system does not determine whether a hand of cards includes a designated card combination prior to enabling the player to select two or more cards to combine. Thus, in certain embodiments, the gaming system enables the player to combine cards to form at least one resultant card without regard to any particular displayed card combination.

Forming Resultant Cards

In various embodiments of the present disclosure, the gaming system enables the player to form a resultant card in any of a plurality of different ways. In certain embodiments, such as the embodiment described above with reference to FIGS. 2A to 2C, the gaming system enables the player to select two or more of the displayed cards to combine to form a resultant card. In these embodiments, for an initial hand of five cards, the resultant card may be formed by combining two, three, or four cards to form a single resultant card.

In certain alternative embodiments, the gaming system enables the player to form resultant cards by selecting a predetermined maximum number of cards. For example, in one embodiment, the gaming system enables the player to select up to three cards to form a resultant card. In certain alternative embodiments, the gaming system enables the player to select only two cards to form each resultant card.

It should further be appreciated that in the example embodiment above, the gaming system enables the player to form more than one resultant card per hand. In certain alternative embodiments, the gaming system enables to player to form a predetermined number of resultant cards per hand. In certain alternative embodiments the number of cards combined to form a single resultant card is based on the wager placed on the play of the game. In certain embodiments, the number of resultant cards permitted to be formed is based on the wager placed on the play of the game.

In various embodiments of the present disclosure, the gaming system determines the resultant value of the resultant card in a plurality of different ways including one or more of a plurality of different mathematical operations. In the example described above with reference to FIGS. 2A to 2C, the gaming system determines the resultant by adding the values associated with two or more cards and the resultant value is the sum of the values associated with the cards combined to form the resultant card. In certain alternative embodiments, the gaming system determines the resultant value through subtraction. More specifically, in one example embodiment, the gaming system enables the player to select at least two cards to combine to form a resultant card. In this example, the gaming system determines the resultant value associated with the resultant card by calculating the difference between the values associated with each of the cards combined to form the resultant card.

In certain alternative embodiments, the resultant value is the result of a different mathematical operation including but not limited to subtraction, multiplication, and division involving the values associated with each of the cards combined to form the resultant card. In various alternative embodiments, the resultant value is determined as a combination of the different mathematical operations. In various alternative embodiments, the gaming system provides one or more available mathematical operations for determining a resultant value and enables the player to select which mathematical operation to employ to form a resultant card. More specifically, in one example, the gaming system provides both addition and subtraction as available mathematical operations for combining cards to form a resultant card. The gaming system enables the player to: (a) select two or more cards to combine, and (b) select which mathematical operation (i.e., addition or subtraction) to employ in determining the resultant value associated with the resultant card. In certain embodiments, the gaming system provides only a single mathematical operation for every play of the game. In certain alternative embodiments, the gaming system provides a different single mathematical operation for different plays of the game. In other alternative embodiments, the gaming system enables the player to select one of a plurality of mathematical operations when combining cards to form a resultant card and determine a resultant value. In certain alternative embodiments, the gaming system cycles through the various mathematical operations to determine the best outcome for the player based on the selection of cards selected by the player to combine to form a resultant card. In certain alternative embodiments, the available mathematical operations are based on the wager placed by the player.

In various embodiments of the present disclosure, the gaming system enables the player to earn or purchase a value to add to a resultant value in a current or subsequent play of a game. More specifically, in one embodiment, the gaming system enables a player to earn or buy one or more extra points or values that can be used in a current play of a game and/or saved for a subsequent play of the game. The gaming system enables the player to: (a) select two or more cards to combine to form a resultant card, and (b) include any earned or purchased extra points or values in the determination of the resultant value associated with the resultant card. Thus, the gaming system enables the player to form a resultant card using the cards displayed and any points or values from a current or previous play of the game.

In various embodiments of the present disclosure, the gaming system enables the player to select which cards to combine to form the at least one resultant card in a plurality of different ways. In the example embodiment described above, the gaming system enables the player to combine any cards of the hand of cards to form a resultant card. In certain alternative embodiments, the gaming system enables the player to combine only cards associated with the same suit to form resultant cards. In one example of this embodiment, the gaming system enables the player to select at least two cards of the same suit to combine to form at least one resultant card. In this embodiment, the resultant card is associated with the same suit. Thus, in this example, the gaming system allows for suit-based wins, such as a Flush.

As described above, in certain embodiments, the gaming system enables the player to select only from drawn cards to form resultant cards. More specifically, in an example employing a draw poker game, the gaming system enables the player to select which cards of the initial hand of cards to hold. Thereafter, the gaming system enables the player to draw cards to replace any unselected cards. In certain embodiments, the gaming system enables the player to combine any drawn cards to form a resultant card. In a variation of this embodiment, the gaming system enables the player to continue to re-draw cards to replace any combined cards. In certain variations of this embodiment, the number of re-draws are based on the wager placed by the player.

Automatic Combination

In various embodiments of the present disclosure, the gaming system automatically forms a resultant card for the play of the game. In the example embodiments described above, the player selects which cards to combine to form the resultant card. In certain alternative embodiments, the gaming system determines which cards to combine to form a resultant card. In certain embodiments the gaming system automatically combines cards for the first hand of cards and/or in certain alternative embodiments, the gaming system automatically combines cards for the second hand of cards. In certain variations of this embodiment, the gaming system suggests which cards to combine and enables the player to bypass the suggestion.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
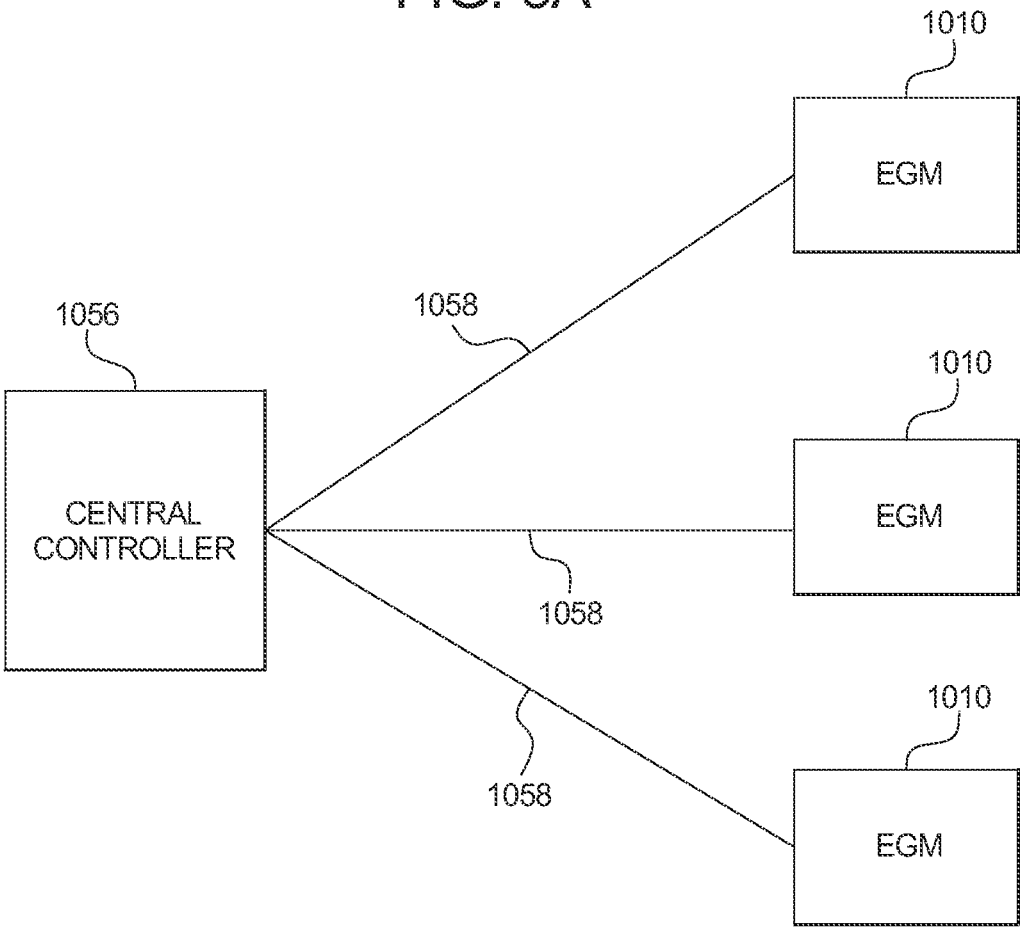
FIG. 3A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 3010 that are each configured to communicate with a central server, central controller, or remote host 3056 through a data network 3058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
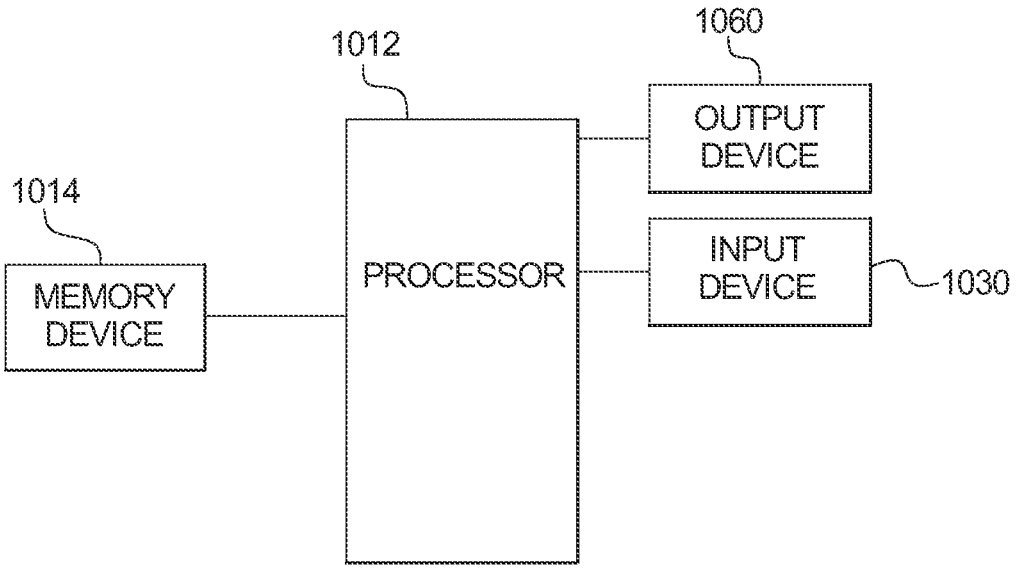
FIG. 3B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 3012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 3014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
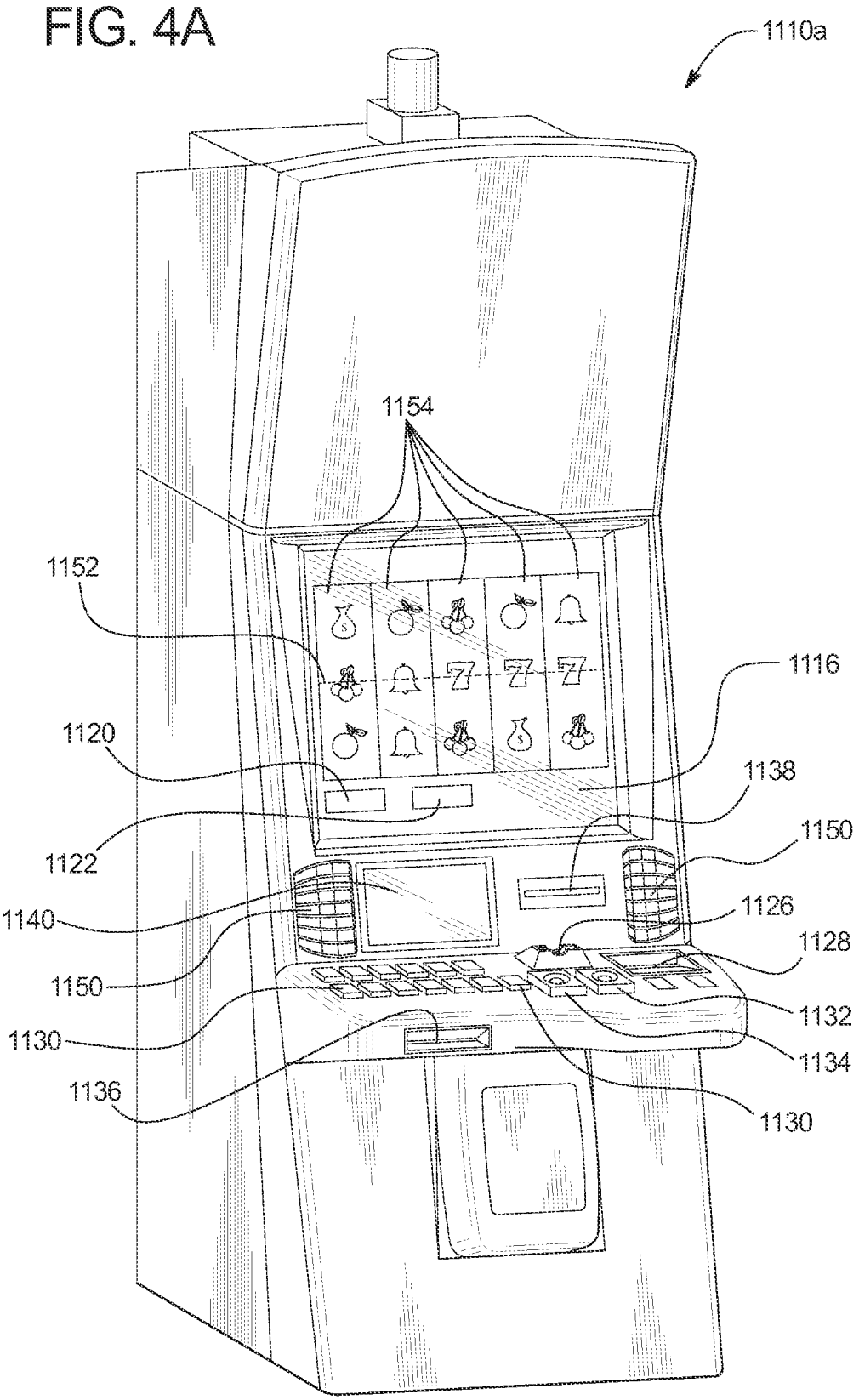
FIGS. 4A and 4B are perspective views of example alternative embodiments of the gaming system of the present disclosure.
Figure 4B:
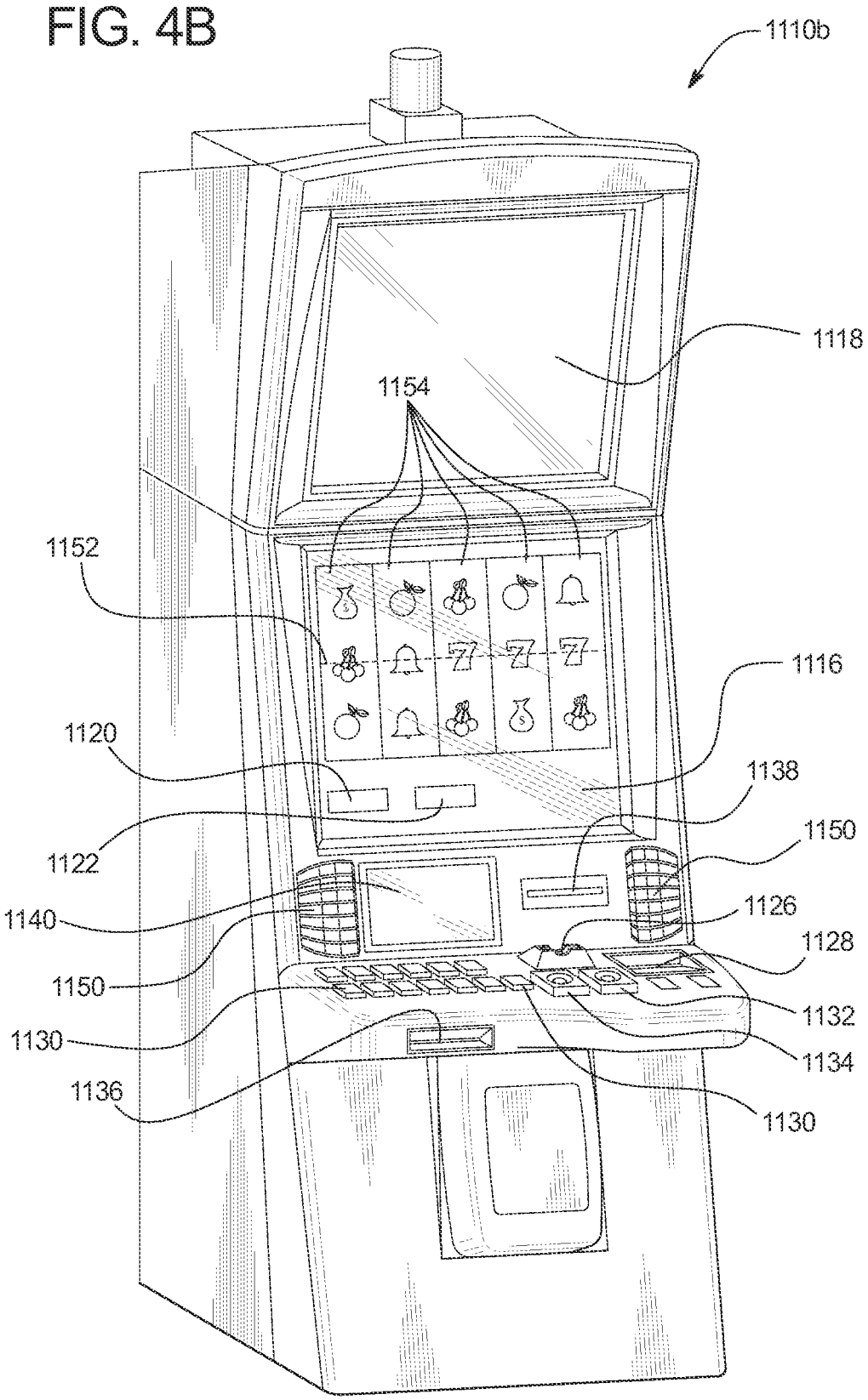

In various embodiments, the EGM includes one or more input devices. The input devices may include any suitable device that enables an input signal to be produced and received by the at least one processor of the EGM. The example EGM illustrated in FIG. 3B includes at least one input device 3030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 3128, and (b) a coin slot 3126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 3132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 3134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 3138. The card reader is configured to read a player identification card inserted into the card reader.

In various embodiments, the EGM includes one or more output devices. The example EGM illustrated in FIG. 3B includes at least one output device 3060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 3116, a player tracking display 3140, a credit display 3120, and a bet display 3122. The example EGM illustrated in FIG. 4B includes a central display device 3116, an upper display device 3118, a player tracking display 3140, a player tracking display 3140, a credit display 3120, and a bet display 3122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 3136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 3150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 4A and 4B include a payline 3152 and a plurality of reels 3154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A gaming system comprising:

at least one processor;

at least one display device;

at least one input device; and at least one memory device storing a plurality of instructions which, when executed by the at least one processor, cause the at least one processor to operate with the at least one display device and the at least one input device, for a play of a game, to:

(i) randomly select a hand of cards from a virtual deck of cards, wherein each card is associated with one of a plurality of different values;

(ii) display the hand of cards;

(iii) if the displayed hand of cards does not include a designated card combination:

(a) enable the player to select at least two of the displayed cards to combine to form at least one resultant card;

(b) enable the player to combine at least one formed resultant card with any available accumulated value to increase an associated resultant value of said at least one formed resultant card, the available accumulated value being separate from any of the cards of the virtual deck; and (c) for each resultant card, determine the associated resultant value;

(iv) evaluate the displayed unselected cards and each of the resultant cards for any winning card combinations; and (v) display any award associated with any winning card combinations.

2. The gaming system of claim 1, wherein the random selection of the hand of cards includes a plurality of instructions, which when executed by the at least one processor, cause the at least one processor to operate with the at least one display device and the at least one input device to:

(i) randomly select a first hand of cards from the virtual deck of cards;

(ii) display the first hand of cards;

(iii) receive a selection of zero, one or a plurality of the cards in the first hand to hold and discard the remaining cards; and (iv) replace the discarded cards with replacement cards from the virtual deck of cards for a second hand of cards.

3. The gaming system of claim 1, wherein the designated card combination includes any winning card combinations.

4. The gaming system of claim 1, wherein the selection of the at least two cards to combine to form at least one resultant card includes a plurality of instructions, which when executed by the at least one processor, cause the at least one processor to operate with the at least one display device and the at least one input device to:

(i) enable the player to select at least two of the displayed cards to combine to form at least one resultant card;

(ii) for each resultant card, determine the associated resultant value;

(iii) receive a selection of zero, one or a plurality of cards to hold, and discard the remaining cards;

(iv) provide replacement cards from the virtual deck of cards.

5. The gaming system of claim 4, wherein the replacement cards include cards to replace any discarded cards and cards to replace any cards combined to form the at least one resultant card.

6. The gaming system of claim 1, wherein the resultant value associated with each resultant card is based at least in part on one of: (a) addition, (b) subtraction, (c) multiplication, and (d) division of the values associated with each selected card combined to form said resultant card.

7. The gaming system of claim 1, wherein the evaluation of the displayed unselected cards and the resultant cards is based on the value associated with each displayed unselected card and the value associated with each resultant card.

8. A method of operating a gaming system, said method comprising:

(i) causing at least one processor to execute a plurality of instructions stored in at least one memory device to randomly select a hand of cards from a virtual deck of cards, wherein each card is associated with one of a plurality of different values;

(ii) causing the at least one processor to execute the plurality of instructions to operate with at least one display device to display the hand of cards;

(iii) if the displayed hand of cards does not include a designated card combination:

(a) causing the at least one processor to execute the plurality of instructions to operate with at least one display device and at least one input device to enable the player to select at least two of the displayed cards to combine to form at least one resultant card;

(b) causing the at least one processor to execute the plurality of instructions to operate with at least one display device and at least one input device to enable the player to combine at least one formed resultant card with any available accumulated value to increase an associated resultant value of said at least one formed resultant card, the available accumulated value being separate from any of the cards of the virtual deck; and (c) for each resultant card, causing the at least one processor to execute the plurality of instructions to determine an associated resultant value;

(iv) causing the at least one processor to execute the plurality of instructions to evaluate the displayed unselected cards and each of the resultant cards for any winning card combinations; and (v) causing the at least one processor to execute the plurality of instructions to operate with the at least one display device to display any award associated with any winning card combinations.

9. The method of claim 8, wherein the random selection of the hand of cards includes causing the at least one processor to execute the plurality of instructions to operate with the at least one display device and the at least one input device to:

(i) randomly select a first hand of cards from the virtual deck of cards;

(ii) display the first hand of cards;

(iii) receive a selection of zero, one or a plurality of the cards in the first hand to hold and discard the remaining cards; and (iv) replace the discarded cards with replacement cards from the virtual deck of cards for a second hand of cards.

10. The method of claim 8, wherein the designated card combination includes any winning card combinations.

11. The method of claim 8, wherein selection of the at least two cards to combine to form at least one resultant card includes causing the at least one processor to execute the plurality of instructions to operate with the at least one display device and the at least one input device to:

(i) enable the player to select at least two of the displayed cards to combine to form at least one resultant card;

(ii) for each resultant card, determine the associated resultant value;

(iii) receive a selection of zero, one or a plurality of cards to hold, and discard the remaining cards;

(iv) provide replacement cards from the virtual deck of cards.

12. The method of claim 11, wherein the replacement cards include cards to replace any discarded cards and cards to replace any cards combined to form the at least one resultant card.

13. The method of claim 8, wherein the resultant value associated with each resultant card is based at least in part on one of: (a) addition, (b) subtraction, (c) multiplication, and (d) division of the values associated with each selected card combined to form said resultant card.

14. The method of claim 8, wherein the evaluation of the displayed unselected cards and the resultant cards is based on the value associated with each displayed unselected card and the value associated with each resultant card.

15. The method of claim 8, which is provided through a data network.

16. The method of claim 15, wherein the data network is an internet.

17. A non-transitory computer readable medium storing a plurality of instructions which, when executed by at least one processor, cause the at least one processor to operate with at least one display device and at least one input device for a play of the game to:

(i) randomly select a hand of cards from a virtual deck of cards, wherein each card is associated with one of a plurality of different values;

(ii) display the hand of cards;

(iii) if the displayed hand of cards does not include a designated card combination:

(a) enable the player to select at least two of the displayed cards to combine to form at least one resultant card;

(b) enable the player to combine at least one formed resultant card with any available accumulated value to increase an associated resultant value of said at least one formed resultant card, the available accumulated value being separate from any of the cards of the virtual deck; and c) for each resultant card, determine the associated resultant value;

(iv) evaluate the displayed unselected cards and each of the resultant cards for any winning card combinations; and (v) display any award associated with any winning card combinations.

18. The non-transitory computer readable medium of claim 17, wherein the random selection of the hand of cards includes a plurality of instructions, which when executed by the at least one processor, cause the at least one processor to operate with the at least one display device and the at least one input device to:

(i) randomly select a first hand of cards from the virtual deck of cards;

(ii) display the first hand of cards;

(iii) receive a selection of zero, one or a plurality of the cards in the first hand to hold and discard the remaining cards; and (iv) replace the discarded cards with replacement cards from the virtual deck of cards for a second hand of cards.

19. The non-transitory computer readable medium of claim 17, wherein the designated card combination includes any winning card combinations.

20. The non-transitory computer readable medium of claim 17, wherein selection of the at least two cards to combine to form at least one resultant card includes a plurality of instructions, which when executed by the at least one processor, cause the at least one processor to operate with the at least one display device and the at least one input device to:

(i) enable the player to select at least two of the displayed cards to combine to form at least one resultant card;

(ii) for each resultant card, determine the associated resultant value;

(iii) receive a selection of zero, one or a plurality of cards to hold, and discard the remaining cards;

(iv) provide replacement cards from the virtual deck of cards.

21. The non-transitory computer readable medium of claim 20, wherein the replacement cards include cards to replace any discarded cards and cards to replace any cards combined to form the at least one resultant card.

22. The non-transitory computer readable medium of claim 17, wherein the resultant value is based at least in part on one of: (a) addition, (b) subtraction, (c) multiplication, and (d) division of the values associated with each selected card combined to form said resultant card.

23. The non-transitory computer readable medium of claim 22, wherein the evaluation of the displayed unselected cards and the resultant cards is based on the value associated with each displayed unselected card and the value associated with each resultant card.

24. The gaming system of claim 1, which includes a housing, and a plurality of input devices supported by the housing, said plurality of input devices including an acceptor, and a cashout device, wherein when executed by the at least one processor, the plurality of instructions cause the at least one processor to operate with the plurality of input devices to: if a physical item is received via the acceptor, establish a credit balance based, at least in part, on a monetary value associated with the received physical item, and if a cashout input is received via the cashout device, cause an initiation of any payout associated with the credit balance.

25. The method of claim 8, wherein a credit balance is increasable based on the displayed award, said credit balance being increasable via an acceptor of a physical item associated with a monetary value, and said credit balance being decreasable via a cashout device.

26. The non-transitory computer readable medium of claim 17, wherein a credit balance is increasable based on the displayed award, said credit balance being increasable via an acceptor of a physical item associated with a monetary value, and said credit balance being decreasable via a cashout device.

27. The gaming system of claim 1, wherein the at least one processor to operates with at least one display device and at least one input device to enable the player to select at least two of the displayed cards having a same suit to combine to form at least one resultant card.

28. The method of claim 8, further comprising causing the at least one processor to execute the plurality of instructions to operate with at least one display device and at least one input device to enable the player to select at least two of the displayed cards having a same suit to combine to form at least one resultant card.

29. The non-transitory computer readable medium of claim 17, wherein the at least one processor to operates with at least one display device and at least one input device to enable the player to select at least two of the displayed cards having a same suit to combine to form at least one resultant card.

30. The gaming system of claim 1, wherein the available accumulated value is at least one of: (a) earned by the player, and (b) purchased by the player.

31. The gaming system of claim 1, wherein the available accumulated value is from a previous play of the game.

32. The method of claim 8, wherein the available accumulated value is at least one of: (a) earned by the player, and (b) purchased by the player.

33. The method of claim 8, wherein the available accumulated value is from the previous play of the game.

34. The non-transitory computer readable medium of claim 17, wherein the available accumulated value is at least one of: (a) earned by the player, and (b) purchased by the player.

35. The non-transitory computer readable medium of claim 17, wherein the available accumulated value is from a previous play of the game.

* * * * *